United States Patent [19]

Johnston

[11] 4,186,429

[45] Jan. 29, 1980

[54] FLASHING LIGHT SAFETY DEVICE FOR CYCLISTS HELMETS

[76] Inventor: Walter A. Johnston, 403 E. Timonium Rd., Timonium, Md. 21093

[21] Appl. No.: 856,579

[22] Filed: Dec. 1, 1977

Related U.S. Application Data

[63] Continuation of Ser. No. 688,045, May 19, 1976.

[51] Int. Cl.[2] ..... F21Q 5/00

[52] U.S. Cl. ..... 362/106; 362/72; 362/368; 362/457

[58] Field of Search ..... 362/105, 106, 107, 397, 362/389, 390, 253, 226, 306, 368, 369, 72, 457; 340/90

[56] References Cited

U.S. PATENT DOCUMENTS

| | | | |
|---|---|---|---|
| 2,860,233 | 11/1958 | Johnson, Jr. | 362/390 |
| 3,325,639 | 6/1967 | King | 362/397 |
| 3,749,902 | 7/1973 | Drew | 240/6.4 W |
| 3,852,587 | 12/1974 | Koehler | 362/106 |
| 3,938,110 | 5/1960 | Busch et al. | 362/106 |
| 3,963,917 | 6/1976 | Romano | 362/106 |

*Primary Examiner*—Samuel W. Engle
*Assistant Examiner*—Edward F. Miles
*Attorney, Agent, or Firm*—Walter G. Finch

[57] ABSTRACT

This invention relates to a method and flashing light safety device for cyclists' helmets which provides for a full 360° elevated identification and protective warning to all surrounding drivers of vehicles. The use of the device will reduce accidents by pin-pointing the location of a cyclist in a stream of traffic or in intersecting lanes of traffic and thereby protect and enhance the safety of the cyclist using the device and the safety of those in vehicles in the surrounding traffic as well as pedestrians. The device is easily detachable for storage or carrying when not in use.

1 Claim, 3 Drawing Figures

FLASHING LIGHT SAFETY DEVICE FOR CYCLISTS HELMETS

BACKGROUND AND SUMMARY OF THE INVENTION

This is a continuation of U.S. application Ser. No. 688,045 filed May 19, 1976.

Cyclists have always faced the problem of being easily identified in the non-daylight hours, including the twilight times at dusk and dawn. Such identification being of a nature that surrounding drivers of vehicles have difficulty in observing and locating a cyclist in order to avoid a contact accident. It should be understood that it is within the scope and intent of this invention that the term cyclist used herein is particularly referenced to motorcyclists, but does not exclude other cyclists, such as bicyclists or other developments of the cycle means of transport.

Safety of the cyclist, and in turn the safety of the drivers of other vehicles in the surrounding traffic, involves not only the lane of traffic in which the cyclist is travelling, but in adjacent lanes to left and right of the cyclist, in lanes of on-coming traffic, and in lanes of intersecting traffic from the left or right, whether at a 90° angle or some other angle with the direction in which the cyclist is travelling. This invention improves and enhances the safety of the cyclist and of all surrounding drivers in the cited instances by pin-pointing the location and movement of the cyclist.

Likewise, the safety of the cyclist and the safety of pedestrians will be similarly improved and enhanced by the device of this invention. Pedestrians' line of view and observation in the cited non-daylight hours will be improved and enhanced by the pin-pointing action of the invention in that the masking effect of background lights, other traffic lighting, etc. will be overcome by the flashing warning signal from the device of this invention.

Another problem that cyclists have had is the ease with which equipment can be handled and used. The device of this invention is conveniently simple. It generally comprises several easily used units, one being a simple, connecting piece permanently attached (by cementing) to the helmet, which in no way interferes with the normal use of the helmet in daylight hours. The balance of the device is an easily connected (and disconnected) unit that attaches to the connecting piece on the helmet and to the electrical system of the cycle. It should be noted that an electrical system is available on motorcycles and it is within the scope and intent of this invention that similar facilities be installed on other cycles that may not be motor-powered when such other cyclists want to use the device of this invention.

As aforementioned, the device of this invention is connected to the electrical system of the cycle for power and and for the flashing mechanism. This permits a lightweight unit to be used and at the same time a very small and compact unit. Making use of the electrical system of the cycle for the abovementioned advantages is distinct for the invention. Nothing shall prevent a user from connecting the unit to a separate battery and flasher that can be carried on or by the user and such an arrangement shall not comprise the scope or intent of the invention.

The unit connecting between the cyclist's helmet and the electrical system of the cycle comprises: a base that attaches into the connecting piece permanently attached to the cyclist's helmet; a globe over the base with a bulb or electrical lamp inside the globe and affixed to the socket in the base; and a coiled electrical cord to connect the base to the electrical system of the cycle. All these individual parts of the connecting unit remain assembled when the unit is disconnected when not in use (as in daylight hours, for example). It should be understood, however, that the device of this invention may also be used in daylight hours if desired for added protection, and such use is specifically desirable on days when visibility is poor, such as in fog, heavy overcast skies, etc.

The connecting unit between the helmet and the electrical system of the cycle, having a coiled electrical cord, permits freedom of movement of the cyclist when on the cycle and is sufficiently flexible to permit easy movement when off the cycle and in close proximity to it for normal cycle adjustments. Nothing shall preclude the cyclist removing his helmet or disconnecting the unit if he so desires when off the cycle but in close proximity to the cycle.

The entire unit is reasonably small and may be carried in the coat pocket when not in use, or stored in a tool container, saddle bag, luggage carrier, or other similar facility on the cycle.

The flashing of the device is provided by the commercial flasher unit of the electrical system of the cycle on which it is used. Where no commercial flasher unit exists on the cycle, one can be installed in the cycle's electrical system.

The references to the cyclist's helmet in the aforementioned description is the standard helmet used by cyclists. As noted previously, the connecting piece on the helmet, to which the connecting unit is attached, is cemented to the helmet and remains permanently attached to the helmet. Thus, the device of this invention may be used with any existing standard cyclist's helmet.

It should also be understood that where users of small four-wheeled vehicles of the "go-cart" variety or similar vehicles are permitted to travel on roads or in areas normally travelled by large motor vehicles or in areas where numerous pedestrains may be walking, and where such operators of such small four-wheeled vehicles wear helmets similar to, or the same as the cyclist's helmet, the use of this invention may be used in a manner similar to the use made of it by the cyclist. Such use is intended under the scope and intent of this application for the invention.

Nothing in the presentation of this invention restricts the use of this invention to one sex of humans, it is applicable to use by both sexes.

Accordingly, it is a primary object of this invention to provide a simple method by which a cyclist can enhance his safety and the safety of others.

It is a further object of the invention to provide a device for a cyclist's helmet that can be permanently attached to the helmet.

It is another object of the invention that the permanently attached device on the cyclist's helmet permits an easy connection and disconnection of a flashing safety device.

It is yet another object of the invention to provide a device for a cyclist's helmet that flashes as a safety warning to protect the cyclist, other motorists, and pedestrians.

It is still another object of the invention to provide a device that can be easily connected to the electrical system of a cycle and yet give freedom of movement to the cyclist on the cycle or when his is off the cycle and close to it.

It is yet still another object that the device can be easily disconnected and carried in a simple manner when not in use.

Further objects and advantages of the invention will become more apparent in light of the following detailed description of the preferred embodiment of the invention.

BRIEF DESCRIPTION OF THE INVENTION

DESCRIPTION OF THE PREFERRED EMBODIMENT

Figure 1:
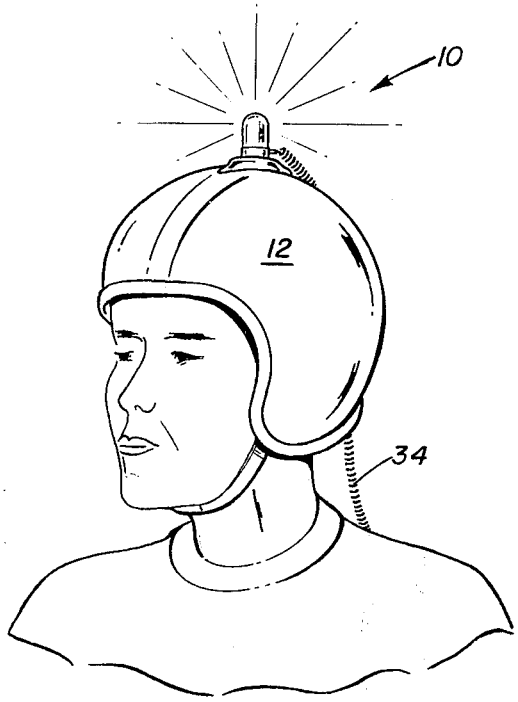
FIG. 1 is a pictorial view showing the light attached to the helmet on a cyclist.

The embodiment of the invention shown in the drawings essentially operates according to the method of the invention, the device shown being merely illustrative since a variety of other components, particularly as to shape, configuration, materials, and positioning, could be used in the practice of the invention without departing from the scope of the invention.

As noted hereinabove, the invention contemplates the safety of cyclists, other motorists, and pedestrians.

The invention will be described as a method and device which is suitable for attachment to a cyclist's helmet and connecting it to the electrical system of a cycle, including the cycle's flasher mechanism.

It is to be understood that devices other than that specifically described, particularly as to shape, configuration, positioning, etc. could be arranged without departing from the scope of the invention. It is also to be understood that the device of this invention can be used by all cyclists, whether on motor powered or manually powered cycles, or by operators of small vehicles wherein helmets are worn when in operation.

Referring now to the drawings, it can be seen from FIG. 1 that the device can be configured as a specific device 10 as the embodiment of the invention. The embodiment is in form of a light globe 28 (FIG. 3) on top of the helmet 12 (FIG. 1) of the cyclist, with a connecting unit 34 (FIG. 1) for connecting to the electrical system 36 (FIG. 2) of the cycle.

Figure 3:
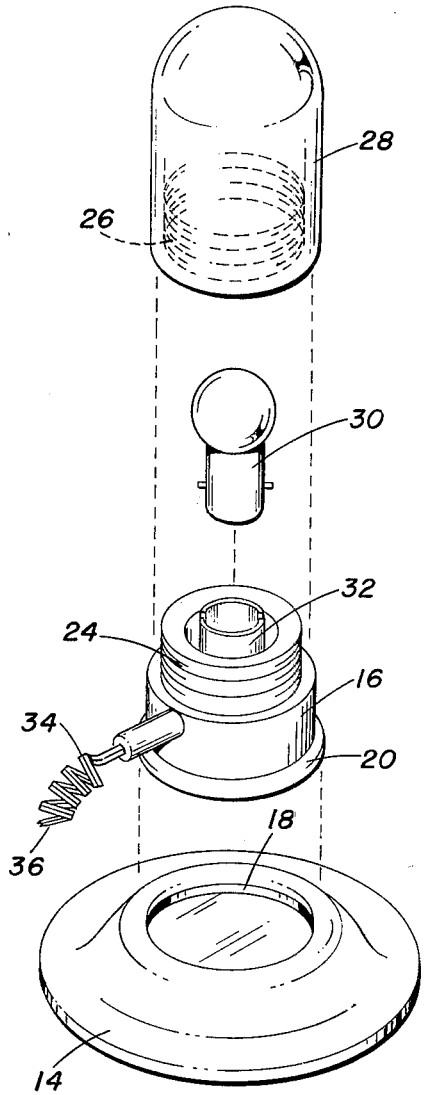
FIG. 3 is an exploded view showing the components of the device.
Figure 2:
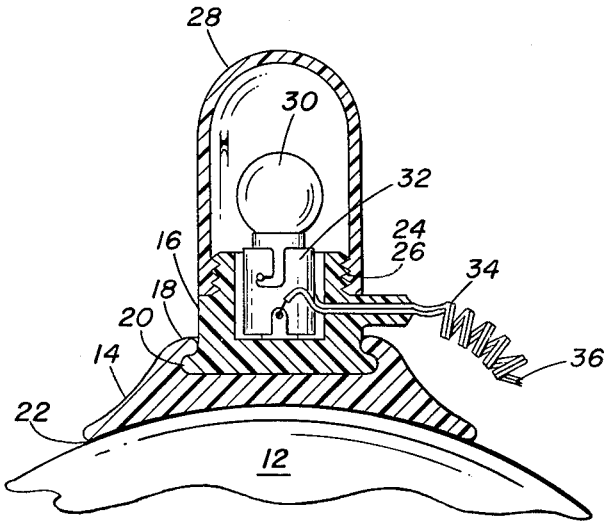
FIG. 2 is a cross section elevation of the light unit attached to a cyclist's helmet.

Referring now to FIGS. 1, 2, and 3 of the drawings, a flexible rubber cup 14 is attached to the helmet 12 with a cement 22 that bonds rubber-type material to the various types of material used in manufacturing cyclist's helmets. The flexibility of cup 14 permits it to be contoured to fit the helmet 12. A plastics base 16 snaps into place in the flexible rubber cup 14. The retaining lip 18 on the flexible rubber cup 14 expands to accept the retaining ring 20 on the plastics base 16 and the retaining lip 18 then contracts around retaining ring 20 to hold the plastics base 16 in place. A commercial bulb (or electrical lamp) 30 is inserted in the socket 32 which is part of plastics base 16. The intensity of the lamp 30 can be in accordance with any legal requirement for such safety devices as may exist and, if necessary, can be subdued in intensity by coloring or by the coloring or opaqueness of the covering glove 28. It should be noted that the color emitted can conform to any legal requirements such as red, yellow, blue, or any such other color as may be required, or as selected if no color is required by law or administrative order.

It should be understood that the variation of color is within the scope and intent of this invention. A globe 28 is attached to the plastics base 16 by means of female screw threads 26 in the globe 28 being screwed on to the male screw threads 24 on the plastics base 16. It should be understood that any other method of connection of the globe 28 to the plastics base 16, such as a friction fit, lug and slot (as in a bayonet-type connection) or any other means of connection is within the scope and intent of this invention.

The aforementioned device on the helmet 12 is connected to the electrical system 36, for both a power supply and the flashing mechanism as hereinbefore described, by means of a flexible coiled cord 34 which is attached to the electrical socket 32 in the plastics base 16 and when in use it is connected to the electrical system 36 of the cycle.

The length of the flexible coiled cord 34 is such so as to give freedom to the cyclist when underway and also is flexible enough to permit the cyclist to dismount for routine servicing or adjusting of units of the cycle.

When not in use the base 16 is disconnected from the cup 14 (wherein retaining lip 18 expands under leverage by the cyclist on base 16 so that retaining ring 20 pops out of the retaining lip 18) and the flexible coiled cord 34 is disconnected from the cycle's electrical system 36. The device 10 is then stored or carried as hereinbefore described.

The flashing of lamp 30 through the globe 28 by means of the flasher mechanism in the cycle's electrical system provides the means of safety by being easily observed by other motorists or pedestrians and permitting the necessary precautions to be taken to avoid accidents.

As should be apparent from the description provided of the embodiment of the invention, other assemblies or configurations of designs could be employed for the method of the invention without departing from the scope of the invention, and it should be apparent from the description provided that the parts that comprise the invention could be varied in shape, configuration, positioning, color, material, or other variation for the method of the invention or the design of the device without departing from the scope of the invention defined by the appended claims.

What is claimed is:

1. A device for providing safety for cyclists, other motorists, and pedestrians, comprising:

a helmet means;

a flashing light means, comprising a lamp, an electrical socket into which said lamp is inserted, and a flexible electrical cord connected to said electrical socket; and a power source capable of conveying power in pulses to said lamp through said electrical cord and said socket, said power source having a capability of connection to a power system of a cycle with which it may be used for providing safety;

a holding means, for holding said flashing light means, comprising a transparent covering over said lamp, and a socket base coupled to said transparent covering and encircling said electrical socket, said transparent covering being capable of displaying emitted artifical light in a 360° spectrum in any one of a variety of colors, said base being a plastics-like material;

a retaining ring molded monolithically on said socket base;

a flexible cup-type base, having an expandable retaining lip monolithically thereon, said retaining lip expanding as said retaining ring snaps into said cup-type base, thereafter said retaining lip contracting around said retaining ring to hold said socket base in plane, said flexible cup-type base being a rubber-like material with a capability of being contoured at time of installation on the contour of said helmet means, said retaining ring on said socket base arranged so as to snap easily into and out of said retaining lip on said flexible cup-type base for easy and quick disassembly into small parts for convenient storage and transport when not in use; and means for attaching said flexible cup-type base to said helmet means at substantially the zenith of said helmet means, said means for attaching said flexible cup-type base to said helmet means comprising an adhesive type cement.

* * * * *